US008747258B2

(12) United States Patent
Durham et al.

(10) Patent No.: US 8,747,258 B2
(45) Date of Patent: Jun. 10, 2014

(54) BATTING TEE

(76) Inventors: Jerry Durham, San Jose, CA (US); Richard J. Wiens, San Jose, CA (US)

( * ) Notice: Subject to any disclaimer, the term of this patent is extended or adjusted under 35 U.S.C. 154(b) by 141 days.

(21) Appl. No.: 13/308,445

(22) Filed: Nov. 30, 2011

(65) Prior Publication Data

US 2012/0165136 A1 Jun. 28, 2012

Related U.S. Application Data

(60) Provisional application No. 61/427,378, filed on Dec. 27, 2010.

(51) Int. Cl.
*A63B 71/00* (2006.01)
*A63B 69/00* (2006.01)

(52) U.S. Cl.
CPC ..... *A63B 69/0075* (2013.01); *A63B 69/00* (2013.01); *A63B 2069/0008* (2013.01); *A63B 69/0002* (2013.01)
USPC ..... 473/417

(58) Field of Classification Search
CPC ..... A63B 69/00; A63B 69/0002–69/0073; A63B 69/0075
USPC ..... 473/417, 422
See application file for complete search history.

(56) References Cited

U.S. PATENT DOCUMENTS 3,039,770 A * 6/1962 Ferretti ..... 473/454
3,876,203 A * 4/1975 Gold ..... 473/417
3,883,138 A 5/1975 Chorey
4,136,869 A * 1/1979 Tassone ..... 473/417
4,176,838 A * 12/1979 Griffin ..... 473/417
4,227,691 A 10/1980 Lefebvre et al.
4,383,686 A * 5/1983 Cardieri ..... 473/417
4,445,685 A * 5/1984 Cardieri ..... 473/417
4,575,080 A 3/1986 Miles
4,830,371 A 5/1989 Lay
4,938,478 A 7/1990 Lay
5,388,823 A * 2/1995 Prieto ..... 473/417
5,967,910 A 10/1999 Lin (Continued)

OTHER PUBLICATIONS

Website, www.amazon.com/gp/product/B001VKAYJU/ref=pd_lpo_k2_dp_sr_1?pf_rd_p=486539851&pf_rd_s=lpo-top-stripe-1&pf_rd_t=201&pf_rd_i=B00099YCLA&pf_rd_m=ATVPDKIKX0DER&pf_rd_r=15ZDNR63CXF8SWPRF2J1, Heavy-Duty Rubber Batting Tee, three pages printed from the internet on Apr. 23, 2010.

(Continued)

*Primary Examiner* — Mitra Aryanpour
(74) *Attorney, Agent, or Firm* — Haverstock & Owens LLP

(57) ABSTRACT

The batting tee has a durable base having a bushing installed therein and telescoping metal ball support pipes extending upwardly therefrom. A protective boot may be installed over the base of the support pipe assembly and bushing to provide a more pleasing appearance and to preclude entry of debris into the threaded connections. The height of the telescoping pipe segments may be locked by a threaded collar at the top of each pipe section. A flexible rod serves as the penultimate component. A replaceable plastic ball holder extends from the upper end of the rod. The ball holder receives the greatest number of inadvertent strikes during play, and accordingly it may be easily replaced if damaged. The flexible rod can flex and bend when the replaceable ball holder is struck, thereby greatly reducing impact force upon the ball holder to provide greater longevity for the holder.

6 Claims, 3 Drawing Sheets

(56) References Cited

U.S. PATENT DOCUMENTS

| | | | | |
|---|---|---|---|---|
| 6,045,462 | A * | 4/2000 | Mourek | 473/417 |
| D451,566 | S | 12/2001 | DeChenne | |
| 6,358,163 | B1 * | 3/2002 | Tanner | 473/417 |
| 6,682,445 | B1 | 1/2004 | Tanner | |
| 6,884,185 | B2 * | 4/2005 | Udwin et al. | 473/417 |
| 7,204,769 | B2 * | 4/2007 | Bandimere et al. | 473/417 |
| 7,674,194 | B2 | 3/2010 | Lortscher | |
| 8,109,844 | B1 * | 2/2012 | Quinn | 473/417 |
| 8,246,492 | B2 * | 8/2012 | Gangelhoff | 473/417 |
| 2003/0036446 | A1 | 2/2003 | Udwin et al. | |
| 2003/0038426 | A1 | 2/2003 | Liao | |
| 2004/0185968 | A1 | 9/2004 | Livingstone | |
| 2006/0019773 | A1 | 1/2006 | Newman | |
| 2006/0264273 | A1 | 11/2006 | Liao | |
| 2007/0105662 | A1 | 5/2007 | Tanner | |
| 2008/0064534 | A1 | 3/2008 | Lortscher | |
| 2008/0085787 | A1 * | 4/2008 | Molloy et al. | 473/417 |
| 2008/0254917 | A1 | 10/2008 | Fischer | |
| 2009/0093325 | A1 * | 4/2009 | Meltzer et al. | 473/454 |
| 2009/0312123 | A1 | 12/2009 | Liao | |
| 2010/0016100 | A1 | 1/2010 | Liu et al. | |
| 2011/0183782 | A1 * | 7/2011 | Wang | 473/417 |

OTHER PUBLICATIONS

Website, www.homerunmonkey.com/homerun-easton-training-aid-tee-lid.html?mybuyscid=10157634295, Easton Tee Lid, two pages printed from the internet on Apr. 23, 2010.

* cited by examiner

BATTING TEE

CROSS-REFERENCE TO RELATED APPLICATION

This application claims the benefit of U.S. Provisional Patent Application Ser. No. 61/427,378, filed Dec. 27, 2010.

BACKGROUND OF THE INVENTION

1. Field of the Invention

The present invention relates generally to games and sports equipment, and particularly to a batting tee having a telescoping support strut and a replaceable upper ball holder extending therefrom.

2. Description of the Related Art

The concept of the batting tee and the associated game of tee ball have been known for some time. In its most basic sense, the batting tee is somewhat analogous to the golf tee, in that it supports the ball in an elevated, stationary mode for striking with the golf club or baseball bat.

Most batting tees developed to the present time are relatively lightweight in their construction to facilitate portability and storage. Such relatively lightweight tees generally do not hold up well for extended use, since many such tees are made almost entirely of lightweight plastic components that tend to deteriorate after some period of use. In some cases, these lightweight tees may not even last for one season of use.

As a result, tees formed of heavier and more durable materials have been developed. These tees are generally constructed of metal pipe with a metal base, providing a relatively inflexible structure. Such metal pipe batting tees are certainly more durable than lighter plastic tees, and are likely to last for several seasons of use. However, their very durability results in other problems for the user. A bat hitting this rigid metal structure, rather than hitting the ball supported atop the structure, will likely be damaged, at least to some extent.

Thus, a batting tee solving the aforementioned problems is desired.

SUMMARY OF THE INVENTION

The batting tee includes a base of high-density polyethylene plastic or other durable material. An adapter or bushing is installed in the base and a column of telescoping metal ball support pipes extends upward from the bushing. A protective rubber or plastic boot may be installed over the base of the support pipe assembly and bushing to provide a more pleasing appearance and to preclude the entry of sand, dirt, etc. into the threaded connections. The height of the telescoping pipe segments may be locked by a threaded collar at the top of each pipe section.

A flexible rod serves as the penultimate component, and a replaceable plastic ball holder extends from the upper end of the flexible rod. The replaceable plastic ball holder receives the greatest number of inadvertent strikes during play, and accordingly it may be easily replaced if damaged. The flexible rod (e.g., polycarbonate, etc.) can flex and bend when the replaceable ball holder is struck, but the flexible rod is less likely to be struck due to its distance below the upper end of the ball holder. Its durability also makes it much less likely to be damaged. A ball is removably placed on the ball holder, and is not tethered or permanently attached the device. The batting tee may be adjusted to any desired height and used for practice, for rehabilitating the batter's swing, for tee ball, etc.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
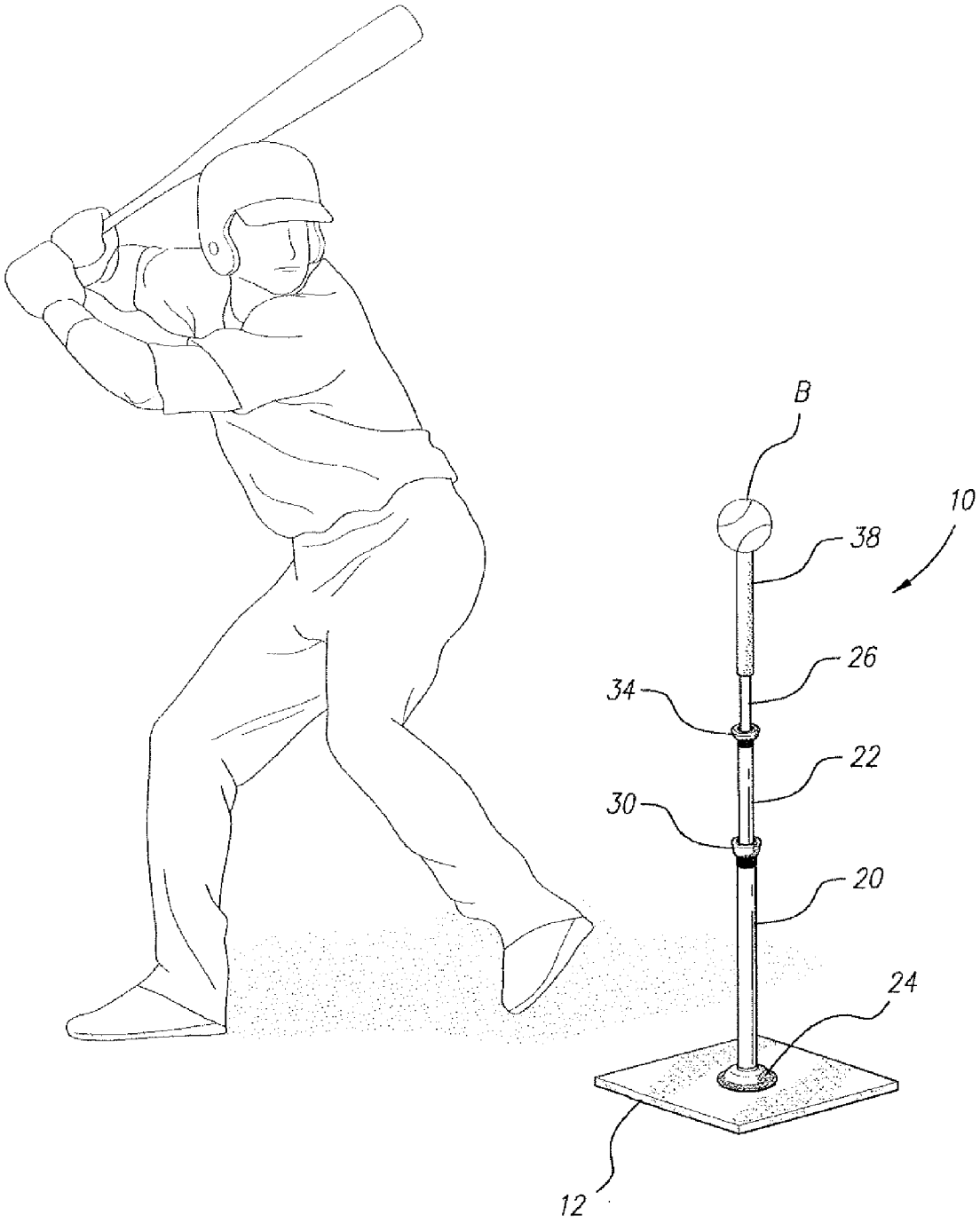
FIG. 1 is an environmental, perspective view of a batting tee according to the present invention.
Figure 2:
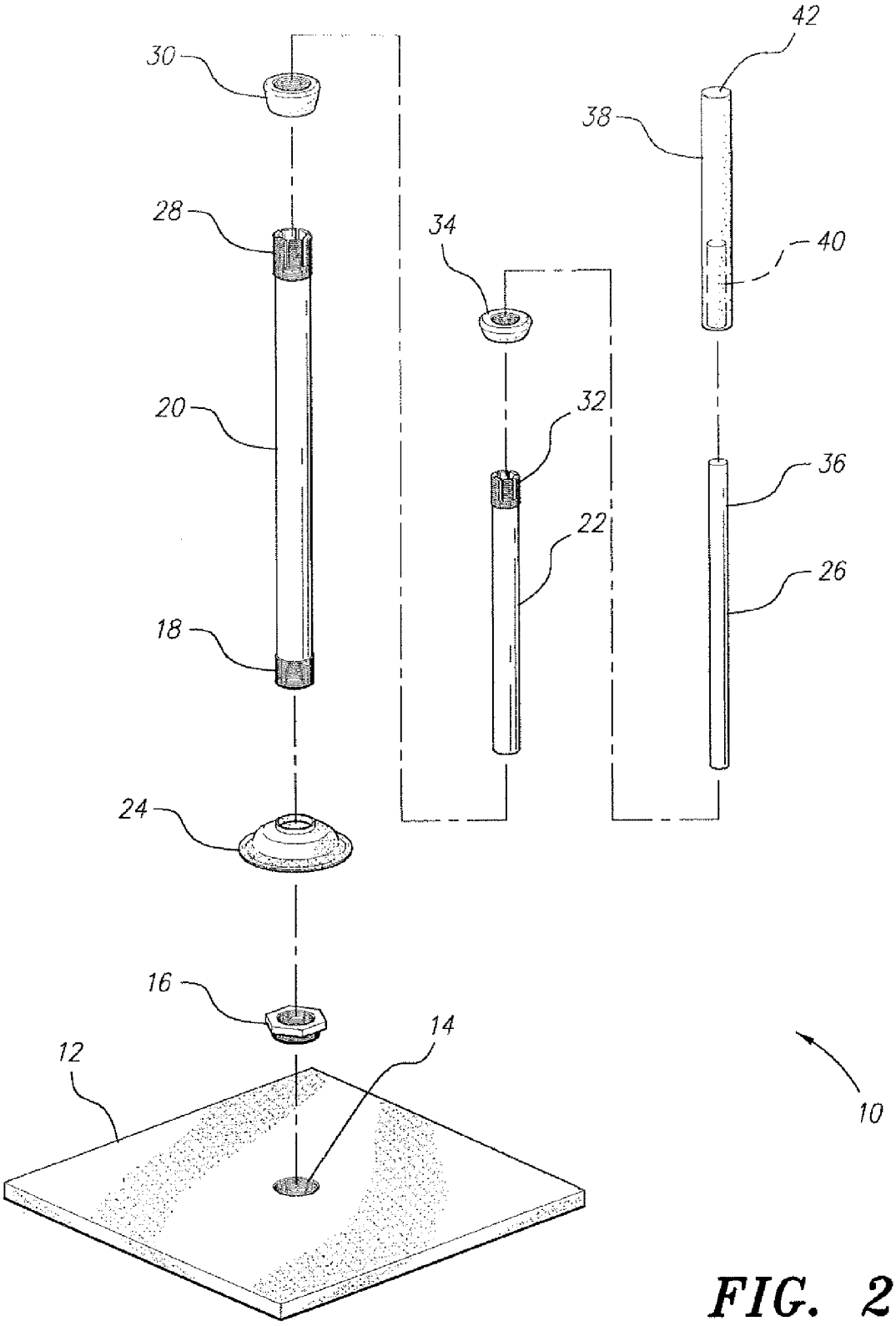
FIG. 2 is an exploded perspective view of the batting tee of FIG. 1, showing further details.
Figure 3:
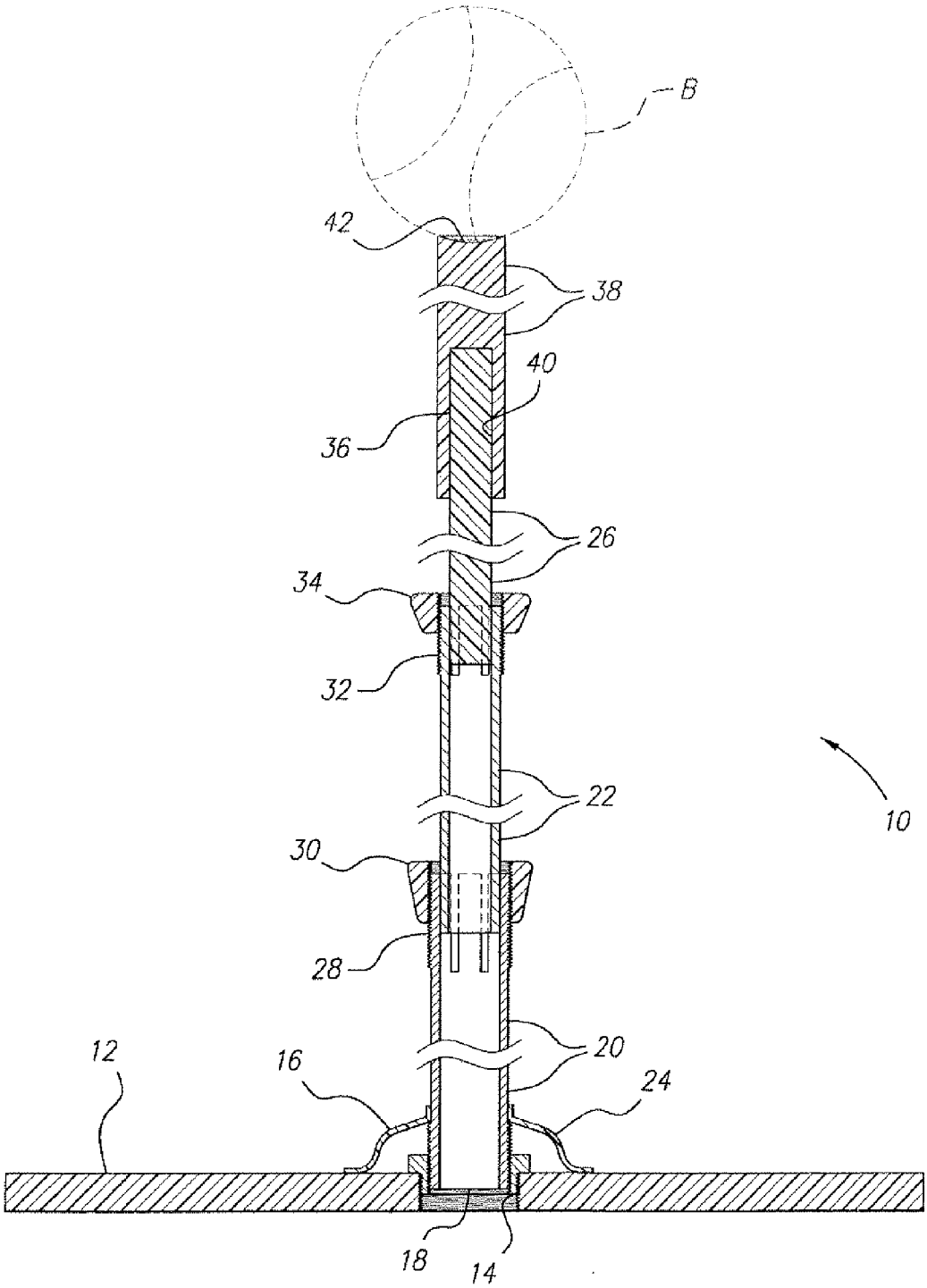
FIG. 3 is an elevation view in section of the batting tee of FIGS. 1 and 2, showing further details.

The batting tee 10 provides is a device for practice in hitting a baseball, for rehabilitating a batter's swing, for playing tee ball, etc. FIG. 1 is an illustration of the batting tee 10 in use, with FIGS. 2 and 3 providing detailed views of the construction of the batting tee 10.

The batting tee 10 has a flat, planar base 12 of reasonably heavy and durable material to provide good stability. The base 12 is preferably formed of a thick sheet or plate of high-density polyethylene plastic (HDPE), but the base may be manufactured of any other suitable material. The base 12 includes a generally centrally located threaded passage 14 (FIGS. 2 and 3) defined therein. The male or externally threaded portion of a pipe bushing 16 is threadably installed in the passage 14 from the top of the base 12. This allows the bottom surface of the base 12 to remain free of protrusions, allowing the base 12 to rest in a stable configuration upon the ground or other surface.

The female or internally threaded portion of the bushing 16 accepts the correspondingly threaded lower end or base 18 of a length of rigid pipe 20 serving as the ball support column (or a portion thereof) for the batting tee 10. The pipe 20 is preferably metal, and more preferably corrosion-resistant steel (e.g., "stainless steel"). A single length of pipe may be used as the ball support column, if desired, but preferably at least two telescoping lengths are provided for height adjustment. In the exemplary embodiment shown in the drawings, a smaller diameter pipe segment 22 telescopes within the lower and larger diameter pipe segment 20. A flexible boot 24 of rubber, plastic, or the like may be passed over the top of the ball support column and seated around the pipe bushing 16 to improve the appearance of the device and to seal out dirt and debris from the threaded pipe bushing connections in the base 12.

A flexible solid rod 26 is installed concentrically in the upper portion of the smaller diameter pipe segment 22. This solid rod 26 is preferably formed of a polycarbonate material, but other materials (e.g., fiberglass) may be used, if desired. The rigid pipe structure provided by the two pipe segments 20 and 22, along with the rigid attachment of the lower segment 20 into the base 12, provides excellent stability for the batting tee 10. However, flexibility is desired for the portion of the ball support column near the ball holder, in the event that the batter severely undercuts the ball. By forming the uppermost portion of the ball support column of a flexible rod 26, damage to the remainder of the batting tee 10 and/or the bat is avoided, or at least greatly reduced.

A compression nut is secured to the upper end of each of the pipe segments to selectively lock the relative positions of the pipe segments 20, 22 and the flexible rod 26 relative to one another. The externally threaded upper end 28 of the first or lower pipe segment 20 has an internally threaded first compression nut 30 installed thereon. The first compression nut 30 selectively grips the outer diameter of the second pipe segment 22 in secure relation to the top of the first segment 20. Similarly, the upper end 32 of the second pipe segment 22 has a somewhat smaller diameter compression nut 34 installed thereon, to selectively grip and lock the position of the flexible solid rod 26 therein. The upper end 28, 32 of each pipe segment 20, 22 has a plurality of radially spaced slots defined therein that extend from the edge of the pipe axially into the threaded portion so that the pipe segment 22 may be telescoped into the base segment 20 (or the flexible rod 26 may be telescoped into the pipe segment 22) to adjust the column to any desired height, the compression nuts 30, 34 clamping the slotted upper ends 28, 32 to the telescoping segment 22 or flexible rod 26. The three telescoping lengths of the ball support column, i.e., the first pipe segment 20, the second pipe segment 22, and the flexible solid rod 26, provide a wide range of vertical adjustment for the ball support column, allowing a ball placed thereon to be at the proper height for a wide range of ages and heights of hitters, and to simulate the heights of a wide range of pitches.

The upper end 36 of the flexible solid rod 26 defines the upper end of the ball support column. A ball holder 38 is installed atop the rod 26. The ball holder 38 is preferably formed of solid plastic and has a concentric receptacle 40 formed in its lower portion, which fits removably over the upper end 36 of the flexible solid rod 26. Thus, the ball holder 38 may be easily replaced on the flexible rod 26 if the holder 38 is damaged. The ball holder 38 also has a shallow depression 42 in its upper end, serving to hold or retain a baseball or softball B therein until the ball is struck by the hitter.

The batting tee 10 may remain assembled for storage, if desired, the support column segments 20 and 22 and the flexible rod 26 being retracted or collapsed as desired to reduce the height of the assembly. Alternatively, the lower or first support column segment 20 may be unscrewed from the bushing 16 in the base 12 for more compact storage. When the batting tee 10 is to be used, the lower support column segment 20 is reassembled in its bushing 26 as required, and the two ball support pipe segments 20 and 22 and the flexible rod 26 are extended to the height desired and locked by means of the two compression nuts 30 and 34. A ball B is placed in the shallow depression 42 atop the ball holder 38, and the batting tee 10 is ready for use. If a batter inadvertently strikes the plastic ball holder 38 or the flexible rod 26, the rod 26 flexes to deflect the impact force and the sturdy rigid pipe components 20 and 22 of the support column and their rigid attachment to the base 12 remain undamaged. In the event that the ball holder 38 is damaged, it is easily replaced by slipping a new ball holder 38 onto the upper end 36 of the flexible rod 26. If the batter strikes the ball B, the ball B leaves the ball holder on a trajectory that depends on the amount of contact between the bat and the ball B, the speed of the swing, the angle or levelness of the swing, etc. Accordingly, the batting tee 10 will provide durable and reliable service for many seasons of practice and play.

It is to be understood that the present invention is not limited to the embodiment described above, but encompasses any and all embodiments within the scope of the following claims.

We claim:

1. A batting tee, comprising:

a flat, planar base providing stability for the batting tee when the batting tee is in use, the base having a threaded passage therethrough;

a bushing threadably attached to the threaded passage of the base;

a first rigid support column having a lower end and an upper end, the lower end threadably received within the bushing, the upper end of the first rigid support column comprising a plurality of radially spaced slots;

a second rigid support column having a lower end and an upper end, the lower end of the second rigid support column telescopically coupled to the upper end of the first rigid support column, the upper end of the second rigid support column comprising a plurality of radially spaced slots;

a first securing mechanism coupled to the upper end of the first rigid support column for adjustably securing the second rigid support column to the first rigid support column, the first securing mechanism comprising a first compression nut that when tightened compresses the radially spaced slots of the upper end of the first rigid support column against the second rigid support column;

a flexible rod having a lower end and an upper end, the lower end telescopically coupled to the upper end of the second rigid support column;

a second securing mechanism coupled to the upper end of the second rigid support column for adjustably securing the flexible rod to the second rigid support column, the second securing mechanism comprising a second compression nut that when tightened compresses the radially spaced slots of the upper end of the second rigid support column against the flexible rod; and a ball holder received on the upper end of the flexible rod for supporting a ball.

2. The batting tee according to claim 1, wherein the ball holder is formed of a solid plastic component removably disposed atop the flexible rod.

3. The batting tee according to claim 1, further comprising a flexible boot disposed over the bushing and the lower end of the first rigid support column.

4. The batting tee according to claim 1, wherein the first rigid support column is formed of a first metal pipe segment and the second rigid support column is formed of a second metal pipe segment.

5. The batting tee according to claim 4, wherein the first metal pipe segment and the second metal pipe segment are made from corrosion-resistant steel.

6. The batting tee according to claim 1, wherein the base is formed of high-density polyethylene plastic.

* * * * *